United States Patent [19]

Castonguay et al.

[11] Patent Number: 4,971,475

[45] Date of Patent: Nov. 20, 1990

[54] PRECAST CURB SYSTEM

[75] Inventors: Bertin Castonguay, Nuns' Island; Alain Ratte, Terrebonne, both of Canada

[73] Assignee: Groupe Permacon Inc., Ville d'Anjou, Canada

[21] Appl. No.: 413,753

[22] Filed: Sep. 28, 1989

[30] Foreign Application Priority Data

Jul. 13, 1989 [CA] Canada ..... 605565

[51] Int. Cl.[5] ..... E01C 11/22

[52] U.S. Cl. ..... 404/7; 404/6; 52/102

[58] Field of Search ..... 404/2, 6, 7, 8, 9, 12, 404/13, 34, 39, 45; 52/102

[56] References Cited

U.S. PATENT DOCUMENTS

| | | | |
|---|---|---|---|
| 2,744,479 | 5/1956 | Hartle | 404/7 |
| 3,037,433 | 6/1962 | Maher | 404/7 |
| 3,822,954 | 7/1974 | Ansgariusson | 404/7 |

FOREIGN PATENT DOCUMENTS

| | | | |
|---|---|---|---|
| 759309 | 10/1956 | United Kingdom | 404/12 |

*Primary Examiner*—Ramon S. Britts
*Assistant Examiner*—Ezio Di Sante
*Attorney, Agent, or Firm*—Foley & Lardner, Schwartz, Jeffery, Schwaab, Mack, Blumenthal & Evans

[57] ABSTRACT

An improved curb section of a predetermined length sub-divided into modules by transverse grooves which give the appearance of shorter blocks and provide for fracturing the curb section at those locations. Each module of the curb section includes a rearward fastening projection having a vertical bore for passing a nail to engage the curb section to pavement or other base. Such linear mold sections are all that are required when a curve is dictated. The mold sections are sub-divided into the modules to form the curve. A method of forming the curb section is provided which includes an open frame moving vertically against a platform and mold shoes for pressing down on the concrete when poured in the mold frame, including plugs for forming the tops of the fastening projections. The plugs are removed after the mold frame is lifted, and then the shoes are removed to leave the formed curb sections on the bottom wall.

4 Claims, 3 Drawing Sheets

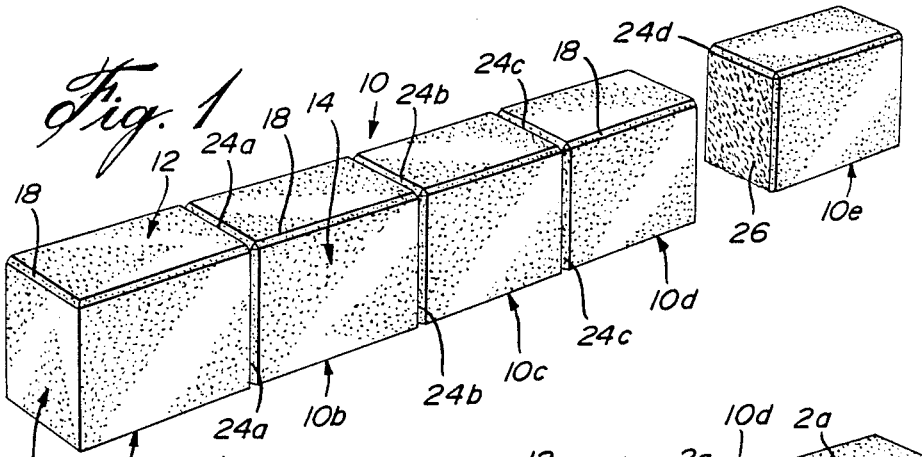
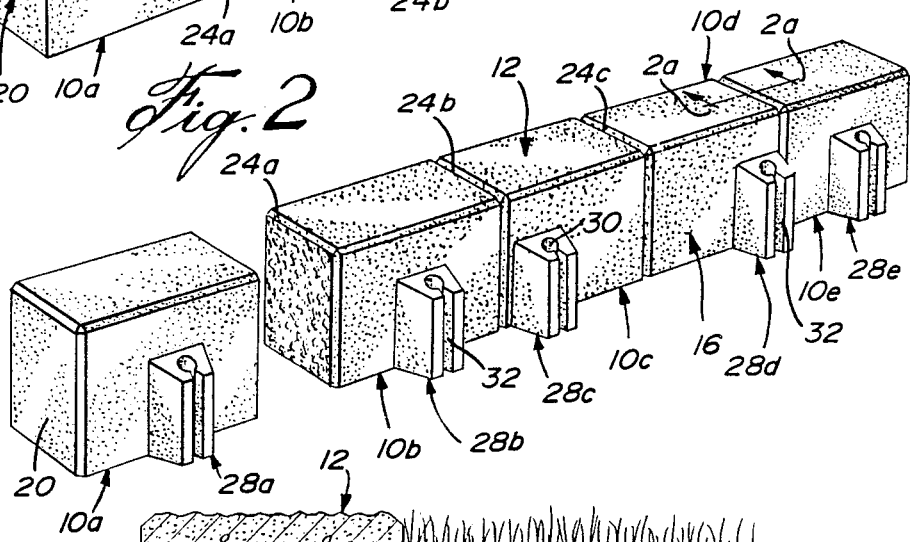
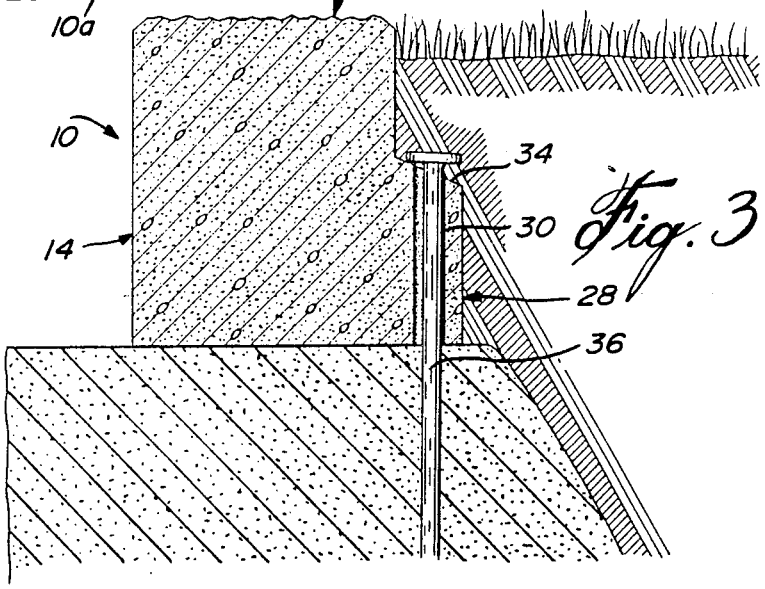
Fig. 3

38
40
44
46
48
49
50
52
58
7
C
D
10a
10b
10c
10d
10e

PRECAST CURB SYSTEM

BACKGROUND OF THE INVENTION

1. Field of the Invention

The present invention relates to precast curb section(s), and more particularly, to an improved precast curb assembly system.

2. Description of the Prior Art

A curb is a shallow border member having a vertical component used for separating a paved road portion from a lawn or sidewalk. Such curbs or curbstones are utilized in landscaping, i.e., between a patio and lawn section or at the edges of parking lots for restraining automobiles and for preventing the paved section from expanding. Traditionally, such curbs are formed in situ or are precast in sections. A precast curb section may be about 1 meter in length, 20 to 30 cm in height and 8 to 15 cm in width. In order to install such precast sections, it is necessary to dig a trench along the edge of the pavement and to install each curb section in the trench such that the curb is flush or projects above the pavement. These curb sections are usually precast concrete or are cut from stone.

Several developments have been made over the years, such as U.S. Pat. No. 3,822,954, Ansgariusson, 1974, whereby fastener means are provided as part of the precast curb section for fastening the curb section to the pavement, thus eliminating the need for providing a trench and requiring an anchor portion to the curb section.

Another problem with precast curb sections is the fact that in a curb layout, the majority of curb sections are assembled in a straight line, but certain portions are curved requiring separate curved sections. Furthermore, designers are often restricted by the predetermined curvature of the available curb section available.

SUMMARY OF THE INVENTION

It is an aim of the present invention to provide a curb section with an improved anchoring and fastening feature.

It is also an aim of the present invention to provide a curb section assembly system which requires but one shape or type of curb section.

It is a further aim of the present invention to provide an improved casting method for molding a plurality of such curb sections.

A construction in accordance with the present invention comprises an elongated curb section of precast concrete having front, top, rear, and bottom surfaces at least partly in respective intersecting planes, and wherein the lines of intersection are parallel. End surfaces are also provided wherein the planes of the end surfaces are parallel and intersect the planes of the front, top, rear, and bottom surfaces. The front, top, and rear surfaces are further intersected by laterally extending spaced-apart grooves which serve to give the appearance of a series of shorter curb modules while providing the curb section with predetermined fractionable portions allowing the curb section to be separated into shorter length modules and fastening projections on the rear surface of the curb section extending vertically, and each fastening projection is provided with a bore extending parallel to the rear surfaces and throughout the height of the projection for passing an elongated fastening means for engaging the base on which the curb is to be installed.

A further aspect of the present invention comprises a mold for casting a plurality of curb sections which includes a mold having a platform and a vertically movable mold frame and mold shoe. The mold shoe forms the top surfaces of the curb sections. The mold frame incorporates a plurality of parallel divider plates, and side walls are suspended at right angles to the platform wall so as to form the side and end surfaces of the curb sections. Alternating ones of the divider plates are provided with vertically extending recesses for defining the projections on the rear walls of the curb sections being molded, and a cylindrical vertical pin member mounted by a shank to the divider plate centrally of each recess is provided for forming the bore in the projection.

The advantage of the curb stone of the present invention is to provide a curb assembly system which is functional and decorative and can be adapted for various design requirements. For instance, the grooves on the exterior surface of the curb section gives each curb section the appearance of a series of shorter blocks. At the same time, the grooves act as score lines to initiate and limit a fracture when it is desired to use shorter curb modules such as when a curve in the curb assembly is dictated or a corner is reached. To form a curve, the curb section would be separated to shorter lengths and laid to form the curve. A fastening projection is predetermined for each fragmented curb section.

BRIEF DESCRIPTION OF THE DRAWINGS

Having thus generally described the nature of the invention, reference will now be made to the accompanying drawings, showing by way of illustration, a preferred embodiment thereof, and in which:

FIG. 1 a perspective view, partly exploded, showing a curb section in accordance with the present invention;

FIG. 2 is a perspective view of the rear of the curb section shown in FIG. 1;

FIG. 3 is a vertical cross-section, taken transversely of the curb section, in a typical operative position;

FIG. 6 is a fragmentary top plan view of a mold box;

DESCRIPTION OF THE PREFERRED EMBODIMENTS

Figure 2A:
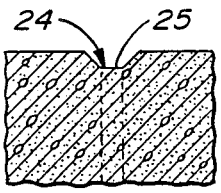
FIG. 2*a* is a fragmentary cross-section taken along line 2*a*—2*a* of FIG. 2.

Referring now to FIGS. 1 and 2, there is shown a curb stone section 10 of precast concrete having a top surface 12 and a front surface 14. As shown in FIG. 1, the curb section has a rear surface 16 and end surfaces 20. All of the edges between the top surface 12 and the front surface 14, rear surface 16 and end faces 20, are bevelled at 18. As shown in FIGS. 1 and 2, transverse grooves 24*a*, 24*b*, 24*c*, and 24*d* are provided which extend across the top surface 12, front surface 14, and rear surface 16. These grooves 24 may be V-shaped with a flat bottom 25 and are continuous about the three faces. These grooves 24 divide the curb section 10 into modules 10*a*, 10*b*, 10*c*, 10*d*, and 10*e* and provide an appearance of a plurality of building blocks instead of long unadorned curbstones. The top surface 12 and front surface 14 can also be provided with a roughened surface to give it the appearance of stone blocks.

The grooves 24*a*, 24*b*, and 24*c* also serve to initiate the fracture of the blocks to a shorter length as will be described later.

On the rear surface 16 there is provided a series of individual fastening projections 28*a*, 28*b*, 28*c*, 28*d* and 28*c*. These projections define a vertical bore 30 communicating with an outwardly opening slot 32. The top surface of the projection 28 is sloped at 34. The height of the projection 28 is at least half the height of the curb section 10. Preferably, there is a fastening projection for each module 10*a*, 10*b*, etc.

A typical curb section 10, in accordance with the embodiment described, has an overall length of 1 meter, a height of 12 cm, and a width of 10 cm. The grooves 24 may have a width of 1.4 cm and a depth of 4 mm. The projection 28 has an overall height of 7 cm and a height of 6 cm at the outermost point thereof. The bore 30 has a radius of 6 mm, and the distance of the projection from the rear surface 16 is 4.0 cm.

As shown in FIG. 3, a typical construction nail 36 can be utilized for anchoring the curb sections at the edge of a pavement in the usual curb location. The nail 36 can be made to penetrate the pavement or a base such as compacted stone provided for such pavement.

The projection 28 has a height which is greater than half the height of the curb section 10 in order to give the anchoring thereof better stability.

Figures 4, 5, 6, 7:
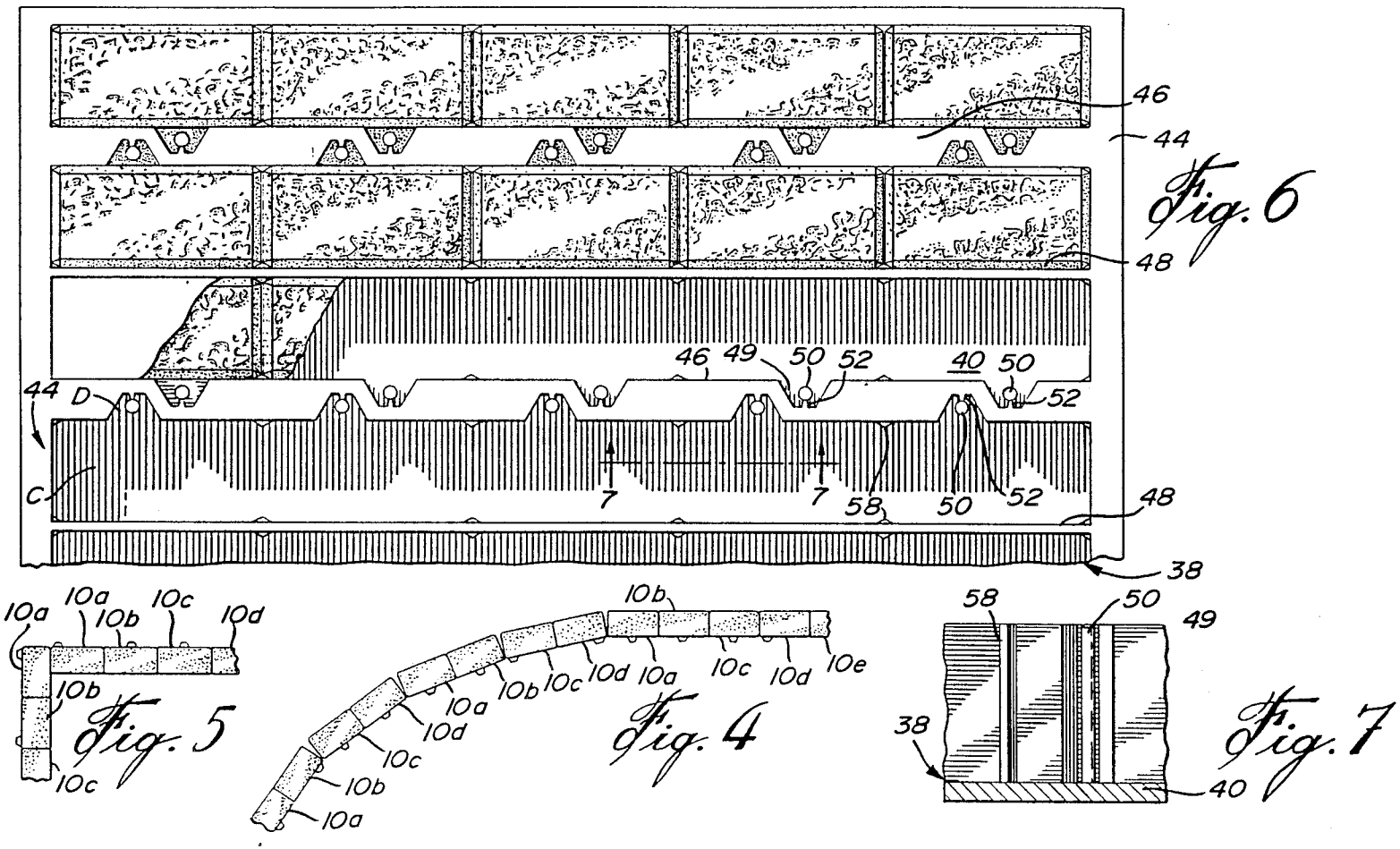
FIG. 4 is a top plan view showing a series of curb sections in accordance with the present invention in a particular arrangement.
FIG. 6 is a fragmentary top plan view of another arrangement.
FIG. 7 is a vertical cross-section taken along line 7—7 of FIG. 6.

In the curb system of the present invention, only one type of curb section would be provided, that is, a linear curb section with approximately five modules divided by the grooves 24. Of course, different varieties of curb sections can be supplied, depending on the appearance required. For instance, the grooves 24 may have varied spacing in order to give the impression of different sized blocks. In any event, in any given installation, one type of straight line curb section would be supplied, and the curb sections can be tailored to the given requirements. For instance, in FIG. 4, there is shown a curved portion of the curb in which curb sections 10 have been divided up into sections of two modules 10*a*, 10*b*, and 10*c*, 10*d*. If the radius of the curve is to be smaller than that shown in FIG. 4, each individual module can be separated and placed to form the curb. If the radius of curvature is to be greater than that shown in FIG. 4, then the module selected can be roughly three blocks. When the curb reaches a corner, as shown in FIG. 5, it may be necessary to section off a curb section fewer than the full size section 10 as provided.

The number of modules is always selected coincident with a groove 24, in which case the curbstone would be fractured along the groove 24.

A typical casting apparatus has been illustrated in FIGS. 6 through 9. A mold frame 44 sits on the platform 40 and includes divider walls 46 and 48 and side walls (not shown). The divider walls 46 include recesses 49 and shanks 52 in the bight of the recess which mount cylindrical vertical pins 50. When the mold frame 44 sits on the platform 40 and concrete is poured into the cavity, two rear surfaces 16 of curb sections 10 are formed by the dividing plate 46. The dividing plate 48 would be a plane surface plate other than for the ribs 58 for forming the grooves for forming the front surfaces 14 of the sections 10. The platform 40 could be a conveyor plate or a vibration table.

Figure 8:
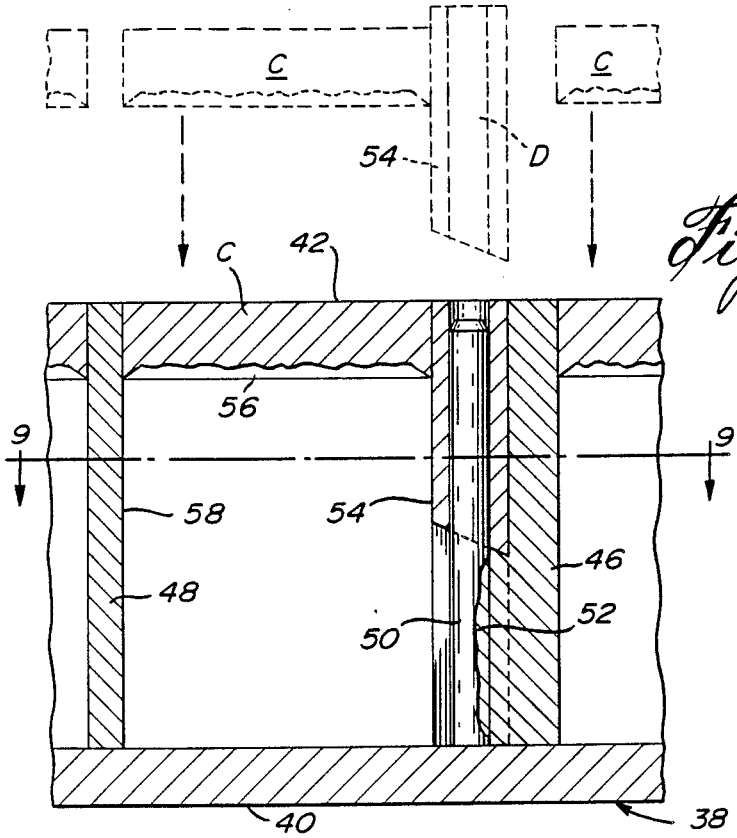
FIG. 8 is a fragmentary vertical cross-section taken transversely of a detail of the mold box.
Figure 9:
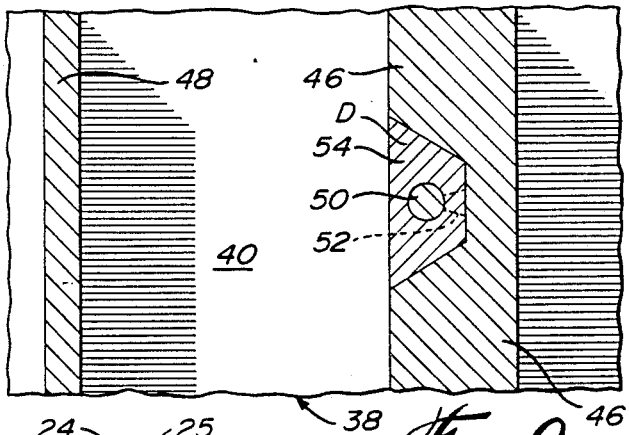
FIG. 9 is a horizontal cross-section taken along line 9—9 of FIG. 8.

As shown in FIG. 8, mold shoes 42 are provided which fit within the openings provided in the mold frame 44. The mold shoes 42 are also provided with plugs 54 which are adapted to fit within the recesses 49 of the divider walls 46 and over the pin 50. The plug 54 limits the height of the projection 28 in the molding process. The plugs 54 are movable relative to the mold shoes 42. The shoe 42 is provided with ribs 56 for effecting the grooves and can be provided with a smooth or roughened stone-like surface as shown in FIG. 8. The apparatus for moving the various mold members is well known and is described in U.S. Pat. No. 4,545,754 issued Oct. 8, 1985 and assigned to Rampf Foreman GmbH.

In operation, when it is required to mold a series of curb sections, the frame 44, with the divider plates 46 and 48, is moved onto the platform 40. The concrete is poured into frame 44, and the shoes 42 with the plugs 54 are then pressed down within the openings provided by the mold frame 44 onto the poured concrete. After the concrete is vibrated, the mold frame 44 is first raised with the shoes 42 remaining in place on the top of the formed curb sections. The plugs 54 are then lifted and then the shoes 42 are removed. The curb sections 10 so formed can then be removed.

I claim:

1. An elongated curb section of precast concrete having front, top, rear, and bottom surfaces in respective intersecting planes wherein the lines of intersection are parallel, end surfaces being provided wherein the planes of the end surfaces are parallel and intersect the planes of the front, top, rear, and bottom surfaces, said surfaces being further intersected by laterally extending spaced-apart grooves continuous about the front, top and rear surfaces which provide the appearance of a series of shorter curb sections while providing the curb section with predetermined fractionable portions allowing the curb section to be separated to shorter length modules, spaced-apart vertical fastening projections on the rear surface of the curb section, each projection extending at least one half the height of the rear surface from the bottom surface, and each fastening projection being provided with a bore extending parallel to the rear surface and throughout the height of the projection for passing an elongated fastening means for engaging the base on which the curb is to be installed, and wherein said projections are spaced apart.

2. A curb section in accordance with claim 1, wherein there is a fastening projection provided on each module.

3. A curb section as defined in claim 1, wherein the anchor projection includes a vertical slot communicating with the bore and tapered walls extend from the rear wall thereof.

4. A system for providing a curb which provides supplying an elongated curb section having front, top, rear and bottom surfaces and of a predetermined length divided into modules by transverse grooves continuous about the front, top and rear surfaces providing fractionable sections defining modules, and spaced apart anchor projections are provided along the rear surface of the curb section, each having a height at least one half the height of the rear surface, and such that there is one anchoring projection for each module laying said elongated curb sections along a predetermined curb path, and fractioning curb sections to one or more modules to form a curve when the curb path is curved, and passing fastening nails through the anchor projections to fasten the curb sections to the edge of the pavement.

* * * * *